US005156520A

United States Patent [19]

Ericson et al.

[11] Patent Number: 5,156,520

[45] Date of Patent: Oct. 20, 1992

[54] LINKAGE SYSTEM FOR LOADING MACHINES

[75] Inventors: Hans Ericson; Mats Andersson; Tord Dahlen, all of Eskilstuna, Sweden

[73] Assignee: VME Industries Sweden AB, Eskilstuna, Sweden

[21] Appl. No.: 678,346

[22] PCT Filed: Nov. 21, 1989

[86] PCT No.: PCT/SE89/00675

§ 371 Date: Apr. 26, 1991

§ 102(e) Date: Apr. 26, 1991

[87] PCT Pub. No.: WO90/06403

PCT Pub. Date: Jun. 14, 1990

[30] Foreign Application Priority Data

Dec. 6, 1988 [SE] Sweden ..... 8804403

[51] Int. Cl.[5] ..... E02F 3/28

[52] U.S. Cl. ..... 414/700; 414/710

[58] Field of Search ..... 414/685, 700, 701, 706, 414/707, 710, 917, 708; 187/8.71, 8.72

[56] References Cited

U.S. PATENT DOCUMENTS

| | | | |
|---|---|---|---|
| 2,817,448 | 12/1957 | Pilch . | |
| 3,001,654 | 9/1961 | Albert | 414/707 |
| 4,364,705 | 12/1982 | Shumaker . | |
| 4,601,634 | 7/1986 | Langenfeld et al. . | |
| 4,609,322 | 9/1986 | Quant | 414/685 |

FOREIGN PATENT DOCUMENTS

| | | | |
|---|---|---|---|
| 1231163 | 12/1966 | Fed. Rep. of Germany | 414/706 |
| 2357365 | 5/1974 | Fed. Rep. of Germany . | |
| 2948480 | 12/1983 | Fed. Rep. of Germany . | |
| 1523548 | 5/1968 | France . | |
| 676502 | 11/1964 | Italy | 414/710 |
| 1086682 | 10/1967 | United Kingdom . | |

*Primary Examiner*—Michael S. Huppert
*Assistant Examiner*—Donald W. Underwood
*Attorney, Agent, or Firm*—Young & Thompson

[57] ABSTRACT

A linkage system for loading machines is mounted on two lift-arms (14) supporting a pallet-lifting fork or a bucket (22) at the ends of the lift-arms. The linkage system is so designed that when using a bucket (22) or pallet-lifting fork the linkage system will ensure that the bucket or lifting fork will take a substantially desired angular position as it is raised and lowered, without needing to make adjustments to the tilt-cylinder as the bucket or lifting fork is raised.

4 Claims, 4 Drawing Sheets

LINKAGE SYSTEM FOR LOADING MACHINES

FIELD OF THE INVENTION

The present invention relates to a linkage system for loading machines of the kind which comprise an automotive vehicle equipped with two lift-arms which can be swung between a lower and an upper terminal position with the aid of hydraulic cylinders, a work-implement, such as a pallet-lifting fork or a bucket, mounted on the outer ends of the lift-arms for pivotal movement about a lower pivot shaft, a linkage system which connects an upper pivot shaft mounted on the implement to a fixed pivot shaft mounted on the frame of the loading machine, beneath the lift-arm journals, through the intermediary of a double-lever shift-arm which is journalled to the lift-arms, either directly or indirectly and which comprises an upper and a lower lever, at least one hydraulic tilt-cylinder which forms a link of adjustable length extension, so that the angle of the implement can be adjusted in relation to the horizontal plane, and a link arrangement which is located at the forward end of the link-arms and which connects the upper lever of the shift-arm to the upper journal shaft of the implement.

BACKGROUND OF THE INVENTION

The implement may comprise a loading bucket, scoop, pallet-lifting fork, a gripping device, for instance for log-loading purposes, or a crane-arm. In the case of known linkage systems, the loader is often only intended for one single work implement, such as a bucket or a pallet-lifting fork. In this respect, it is endeavoured to move a filled bucket with the bucket constantly level, i.e. in parallelism, so as to prevent readily-pourable material from running from the bucket as it is lifted. In the case of a pallet-lifting fork, it should be possible to lift and lower the fork in parallelism, so as to prevent the load carried by the fork from sliding-off. This state of parallelism can be achieved relatively simply by adapting the system for parallel or leveling movement of a single work-implement with the tilt-cylinders locked.

U.S. Pat. No. 2,817,448 teaches a loader which is intended primarily for use with a loading bucket, where the bucket has a lower pivot-shaft on which the outer end of the lift-arm is journalled, and an upper pivot-shaft which is connected to one end of a connecting link, the other end of which link is connected to a tilt-cylinder. This, in turn, is connected to the upper lever of a two-lever shift-arm which is journalled on the lift-arm and the lower lever of which is connected by means of a link to a pivot shaft on the vehicle frame, at a location beneath the pivot-shaft of the lift-arm. The connecting link is carried by a pivot link, the upper end of which is connected to a pivot connection which is common to both the connecting link and the pivot link, and the lower end of which is pivotally connected to the lift-arm.

With linkage arrangements of this known kind it has been necessary hitherto to choose between good bucket-parallelism and a fork-parallelism which is so poor as to render it necessary to follow-up with the tilt cylinder and to adjust the length extension of the cylinder gradually so as to maintain desired parallelism, or levelling, of the fork, and vice versa when priority is given to good fork-parallelism. This gradual adjustment of the tilt-cylinder, or piston, carried out by the driver during a tilting operation, is a tiresome task.

It is known, however, that the functional characteristics of the system can be changed, inter alia by enabling the connection of the system to the vehiclechassis to be shifted from one pivot shaft to another, in the manner described in Swedish Patent Specification No. 8008328-0. This solution, however, requires considerable work to be carried out with heavy components, which may be difficult to handle on the working site.

The components forming part of a linkage system may vary in many ways, as is evident for instance, from French Patent 1,523,548, U.S. Pat. No. 4,609,322 and German LayOut Print 23 57 365, the teachings of which publications lie outside the scope of claim 1, however. These patents specifications are mentioned for the sole purpose of illustrating the many various attempts which have been made to obtain different linkage systems with different functions and characteristics.

SUMMARY OF THE INVENTION

The object of the present invention is to provide an improved linkage system of the kind defined specifically in the preamble of the following claim 1, by arranging and combining known components in a manner such that while retaining satisfactory tilting-torque of the tilt-cylinder on the work implement, the linkage system will ensure that when using a pallet-lifting fork, the fork will take a desired angular position as it is raised and lowered, and that at the same time essentially the same result is obtained with a filled bucket in its upwardly swung position, without needing to make adjustments to the tilt-cylinder as the work implement is raised. This enables the tilt-cylinder to be locked in both cases.

It shall thus be possible to use the inventive linkage system to achieve either fork-parallelism or bucket-parallelism without needing to effect troublesome and time-consuming adjustments to the position of the pivot shafts or to the tilt-cylinder.

This object is achieved with a linkage system constructed in accordance with the invention and characterized in that the lower, and shorter lever of the double-lever shift-arm is connected to the fixed frame-mounted pivot-shaft of the system by one single tilt-cylinder which is located centrally between the lift-arms; in that the connection between the upper and lower lever of the shift-arm and the upper pivot shaft of the implement consists in a longer link which is connected at its forward end to a shorter link forming part of the linkage arrangement; and in that the shorter link is supported approximately midway between its ends by a pivot link, the upper end of which is pivotally connected to the shorter link and the lower end of which is pivotally connected to the lift-arms, either directly or indirectly.

By drawing, in a known manner, the linkage system in a lower terminal position, an intermediate position and an upper terminal position or further positions for lifting a fork in parallelism, and by making the same drawings for an upwardly swung bucket, it is possible to establish the adjustments which need to be made to the lengths of the links and to the positioning of the pivot shafts in order to establish the location of the frame-carried pivot point for the rear-end of the tilt-cylinder which is essentially common to all positions. In practice, it is elected to achieve good parallelism in respect of fork movement and to permit a wider deviation on the part of the bucket, although when using the inventive linkage system this deviation will be so slight as to obviate the necessity of adjusting the length extension of the tilt-cylinder during a lifting operation. At the same time, the desired relatively large tilting-moment on the bucket is retained by means of the principally known connection of the tilt-cylinder to the bucket. This satisfies the desire to be able to use the system advantageously for other work purposes.

BRIEF DESCRIPTION OF THE DRAWINGS

The invention will now be described in more detail with reference to the accompanying drawings.

DETAILED DESCRIPTION OF THE INVENTION

Figure 1:
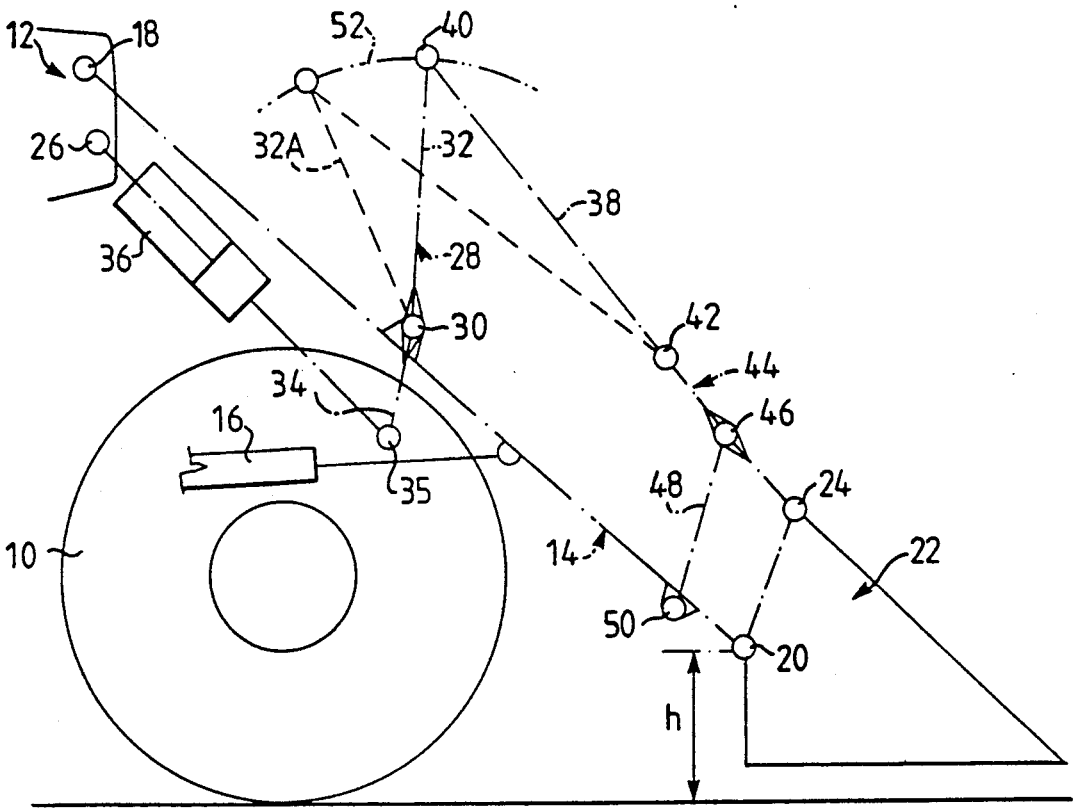
FIG. 1 is a schematic illustration of a vehicle provided with an inventive linkage system.

FIG. 1 illustrates schematically the inventive linkage system installed on a vehicle, the wheels of which are referenced 10 and which includes a frame 12.

Two substantially symmetrically positioned lift-arms 14 can be swung between a lower and an upper terminal position by means of a pair of hydraulic cylinders 16.

The lift-arms are pivotally connected to a pivot shaft 18 mounted on the frame 12. Mounted on the outer ends of the lift-arms is a pivot shaft which forms the lower pivot shaft 20 for pivotal attachment of a work implement in the form of a bucket 22.

The bucket has an upper pivot shaft 24 which is connected to a pivot shaft 26 on the frame 12 located beneath the shaft 18 of the lift-arms, via the aforesaid linkage system. This connection includes a double-lever shift-arm 28 which forms part of the linkage system and which, by a pivot journal 30, is journalled on a cross-piece extending between the lift-arms, this journalling being effected indirectly via a bracket structure. The shift-arm has an upper, and longer lever 32 and a lower, and shorter lever 34.

Connected between the fixed pivot shaft 26 and the pivot pin 35 of the lower lever 34 is one single tilt-cylinder 36, which functions as a length-extensible link for adjusting the implement 22 to desired angular positions in relation to the horizontal plane. Located at the forward end-part of the lift-arms is a link arrangement which includes a longer link 38, one end of which is connected to the pivot pin 40 of the upper, longer lever 32, and the other end of which is connected to one end of a shorter link 44, via a pivot connection 42, whereas the other end of said shorter link is connected to the upper pivot shaft 24 of the work implement.

Located approximately centrally of the ends of the short link is a pivot connection 46 for the upper end of a pivot lever 48, the lower end of which is connected to the lift-arms 14 by means of a pivot connection 50.

In principle, the link arrangement 44, 48 is known for the purpose of generating a relatively large tilting-torque on the work-implement, and it is, in principle, also known to position the tilt-cylinder between the shorter lever 34 and the frame 12. However, when taken together these components constitute a novel and useful combination by means of which the desired parallelism of both the lifting-fork and the upwardly swung bucket can be achieved with locked tilt-cylinders.

In order to achieve the advantages capable of being afforded by the invention, it has been found that the lengths of the different levers between their respective pivot points should have a given relationship in respect of one another. For instance, the relationship between the length of the long link 38, which is connected to the long lever 32 of the shifting-arm, and the length-extension of the lift-arm 14 between its pivot points 18, 20 should be in the region of 0.30–0.50, preferably about 0.40.

Furthermore, the relationship between the length of the link 38 and the distance between the pivot point 30 of the shift-arm and the lower pivot point 50 of the pivot lever 48 should be in the region of 0.8–1.1, preferably about 0.9.

The relationship between the length-extension located between the inner pivot point 18 of the lift arm and the pivot shaft 30 of the shift-arm and the length of the lift-arm 14 should be in the region of 0.4–0.5, preferably approximately in the middle of this range.

When the lower lever 34 must, of necessity, be relatively short, due to the presence of peripheral components, the ratio between the length of this lever and the length of the lift-arm 14 will preferably be in the region of 0.1–0.2. The relationship between the length of the long lever 32 of the shift-arm and the length of its short lever 34 will then preferably lie within the range of 2.0–2.3.

As before mentioned, it is possible to establish with the aid of known constructional methods the location of pivot point 26 which is essentially common to the fork linkage system and bucket linkage system respectively.

In the case of the system illustrated in FIG. 1, the pivot point 40 will perform different movements in relation to the lift-arm 14, depending on the length extension of the tilt-cylinder 36 when the cylinder is locked in position.

As will be evident from the following, the cylinder is adjusted essentially to its central position, in order to obtain fork-parallelism, whereas the cylinder is extended to a given position when the implement concerned is a bucket which shall move in parallelism when being lifted from an upwardly swung position. In order to achieve the desired parallel movement of the lifting fork and bucket, it is possible, when determining the construction of the system, to select a particular shift-arm configuration, as distinct from earlier known systems, by changing the angle between the upper lever 32 and the lower lever 34. The reference 32A identifies an alternative upper-lever position which affords a larger angle between the levers and the changed conditions around the circle 52 described by the pivot point 40 as the shift-arm is swung. Thus, it is possible to choose which part of the circle shall be utilized. Different linear displacements of the long link 38 are obtained at different angles between the levers 32, 34 with one and the same angular deflection of the shiftarm 28, as will be seen when studying FIG. 1.

The angle to which the shift-arm is adjusted can be selected so as to influence the relationship between the torque generated by rotation of the tilt-cylinder 36 and the long link 32 about the pivot shaft 30. Thus, it is possible to choose between a high braking-torque when the bucket digs into the ground, at the cost of a lower torque when emptying the bucket at a high, elevated level. Alternatively, it is possible, with the aid of the same means, to choose to generate the greatest torque when a load-carrying implement, such as a log-gripping implement is discharged of its load with the lift-arms at maximum elevation, at the cost of a lower torque when the implement picks up its load at ground level.

Thus, the inventive linkage system enables the system to be adapted for different types of work and different desiderata associated therewith with the aid of simple means, therewith rendering the inventive linkage system highly versatile.

Figure 2:
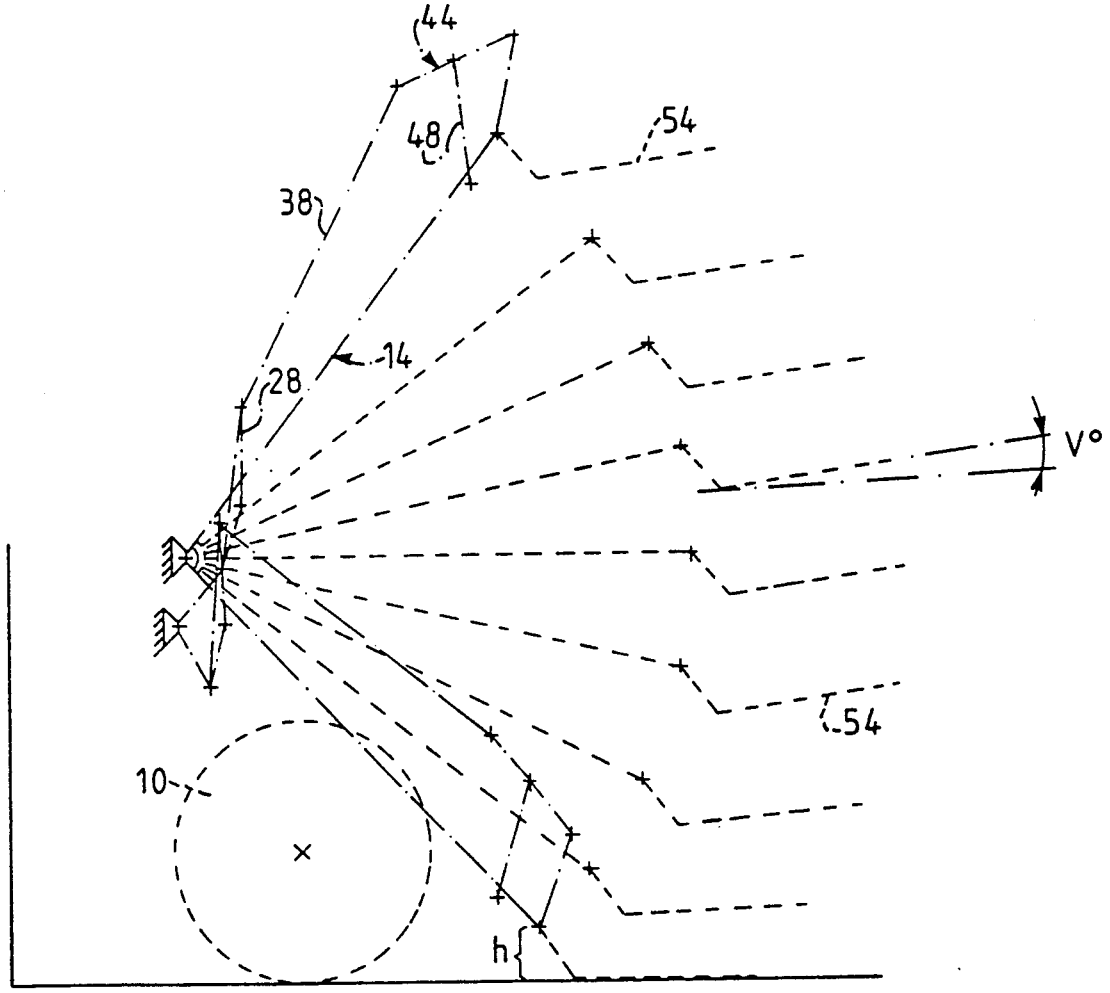
FIG. 2 illustrates schematically the various positions of the linkage system in respect of a lifting fork.

FIG. 2 illustrates schematically the various positions of the linkage system for achieving essentially parallel-movement of a lifting fork 54.

Figure 3:
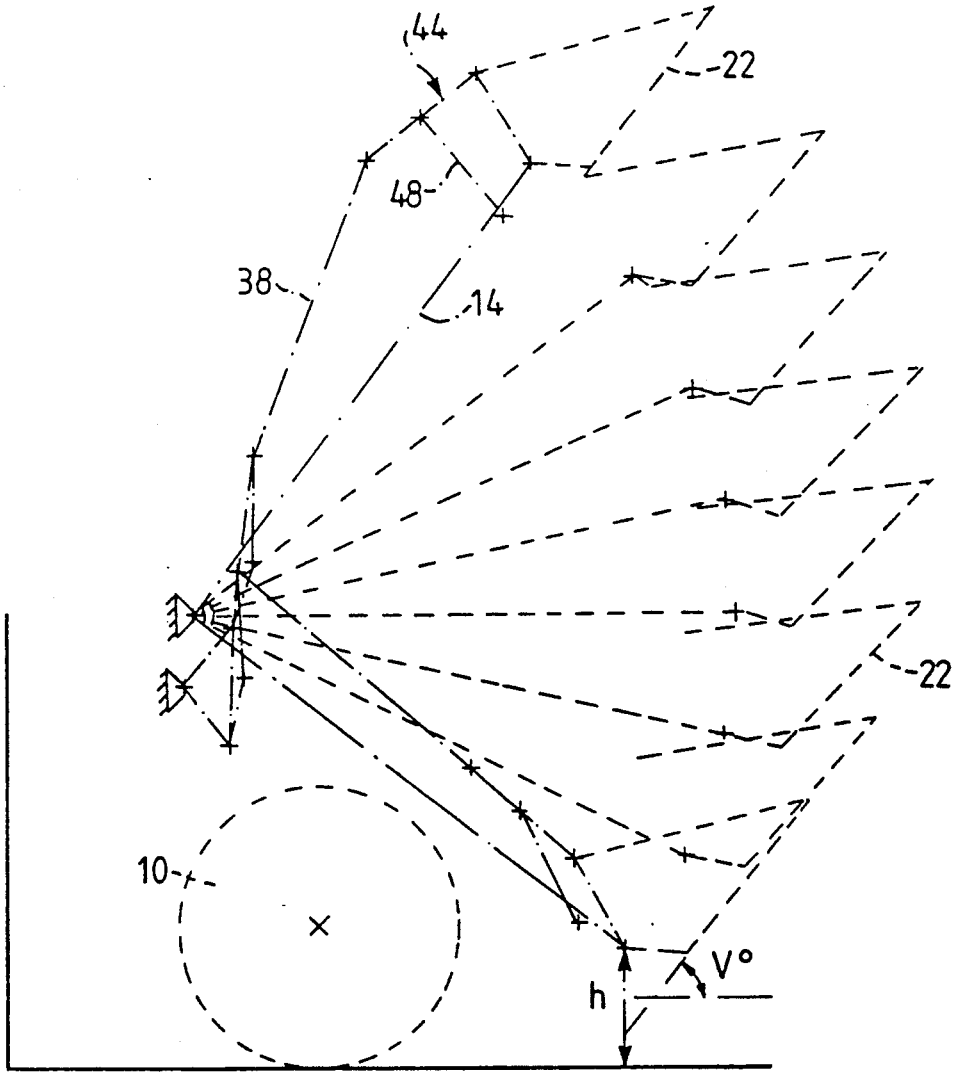
FIG. 3 illustrates schematically the various positions of the linkage system in respect of a loading bucket.

FIG. 3 illustrates the various positions of the linkage system for achieving essentially parallel-movement of the bucket 22.

Figure 4:
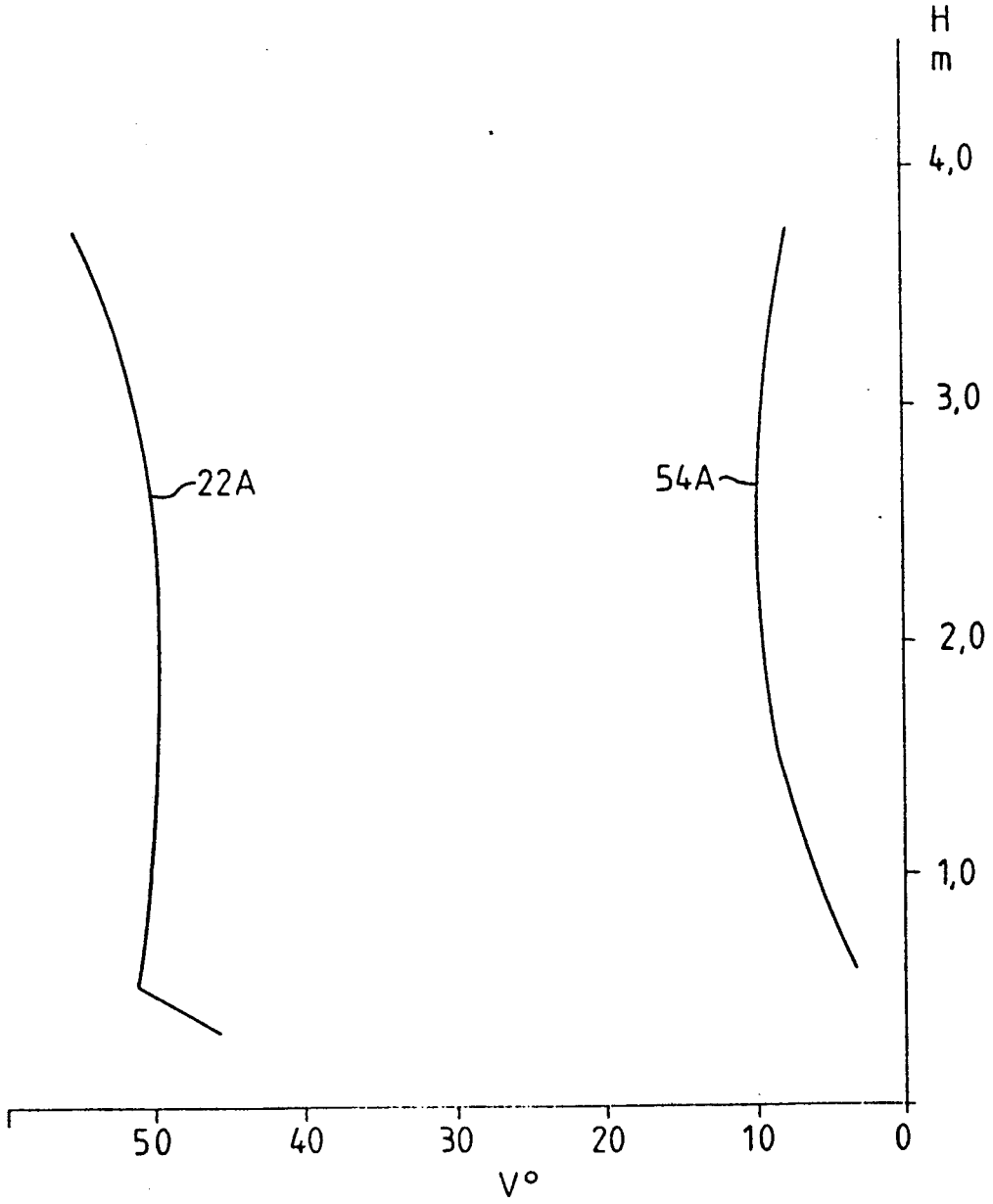
FIG. 4 is a diagram presenting two curves, of which one curve shows the angular variations of the bucket as a function of lifting height, and the other curve shows the angular variations of the lifting-fork as a function of lifting height.

FIG. 4 is a diagram which presents a curve 54A illustrating the fork-angle changes, V-degrees, which occur when the fork is raised, given in meters h, whereas the curve 22A illustrates the bucket-angle changes, V-degrees, in an upwardly swung position while being lifted through h meters.

If desired, the system can be adjusted so that the curve 22A will be a substantially straight vertical line, although the curvature of the line 54A will then be more pronounced, i.e. increased variation in the bucket angle. The illustrated curves present a compromise with acceptable values for a locked tilt-cylinder during a lifting operation, with both fork and bucket.

The linkage system includes only a relatively small number of components, therewith reducing manufacturing costs to a corresponding degree.

The view from the driving seat is relatively good. The tilt-cylinder 36 lies low in the region between the lift-arms 14 and the shift-arm 28 and, seen from above, the long and short levers 32, 34 form relatively narrow or slim components which will not obstruct the view of the driver.

We claim:

1. A linkage system for loading machines of the kind which comprise two lift-arms (14) which can be swung between a lower and an upper terminal position by means of hydraulic cylinders (16); a work-implement (22) pivotally mounted on a lower pivot shaft mounted on outer ends of the lift-arms (14); said linkage system connecting an upper pivot shaft (24) of the implement with a fixed pivot shaft (26) mounted on a frame (12) of the machine, beneath a lift-arm journal-shaft (18) through the intermediary of a double-lever shift-arm (28) journalled on the lift-arms via a pivot journal (30), said double-lever shift-arm (28) having an upper and a lower lever (32 and 34 respectively), said upper lever (32) being longer than said lower lever (34), at least one tilt-cylinder (36) forming a link of adjustable length extension such as to enable adjustments to be made to the angle of the implement relative to a horizontal plane, and a link arrangement (38, 44, 48) located at a forward end-part of the lift-arms and connecting the upper lever (32) of the shift-arm with the upper pivot shaft (24) of the work implement via a connection, said lower, and shorter lever (34) of the shift-arm (28) being connected with the fixed frame-mounted pivot shaft (26) of the system by said at least one tilt-cylinder (36) located centrally between the lift-arms (14); said connection between the upper and longer lever (32) of the shift-arm and the upper pivot shaft (24) of the implement (22) including a longer link (38) having a forward end pivotally connected to a shorter link (44) which forms part of the link arrangement; said shorter link carrying approximately centrally between its ends, a pivot lever (48) having an upper end pivotally connected to the shorter link, via a pivot connection (46) and a lower end pivotally connected to the lift-arms via a lower pivot point (50), whereby the ratio between the length of the lower and shorter lever (34) of the shift-arm to the length of the lift-arm (14) is between 0.1–0.2.

2. A linkage system according to claim 1, wherein the ratio between the length of the longer link (38), which is connected to the long lever (32) of the shift-arm to the length of the lift-arm (14) between its pivot points (18, 20) is between 0.3–0.5, the ratio between the length of the longer link (38) to the distance between the pivot journal (30) of the shift-arm and the lower pivot point (50) of the pivot lever (48) is between 0.8–1.1, and the ratio between the length extension between the inner pivot point (18) of the lift-arm and the pivot journal (30) of the shift-arm to the length of the lift-arm (14) is between 0.4–0.5.

3. A linkage system according to claim 2, wherein the ratio between the length of the upper, and longer lever (32) of the shift-arm to the length of the lower, and shorter lever (34) of said shift-arm is between 2.0–2.3.

4. A linkage system according to claim 2, wherein the ratio between the length of the longer link (38) which is connected to the long lever (32) of the shift-arm to the length of the lift-arm (14) between its pivot points (18, 20) is about 0.40, and the ratio between the length of the longer link (38) to the distance between the pivot journal (30) of the shift-arm and the lower pivot point (50) of the pivot lever (48) is about 0.9.

* * * * *